United States Patent [19]

De Capitani

[11] 4,178,945

[45] Dec. 18, 1979

[54] CIGARETTES HAVING AN INDIVIDUAL LIGHTING MEANS, AND METHOD OF MAKING THEREOF

[76] Inventor: Francesco De Capitani, Corso Magenta 83, Milan, Italy

[21] Appl. No.: 760,768

[22] Filed: Jan. 10, 1977

[30] Foreign Application Priority Data

Jan. 26, 1976 [IT] Italy ..... 19580 A/76

[51] Int. Cl.[2] ..... A24C 5/60; A24D 1/08

[52] U.S. Cl. ..... 131/23 R; 131/24; 131/7; 131/185

[58] Field of Search ..... 131/7, 185, 234, 20 R, 131/21 R, 27 R, 27 A, 32, 33, 36, 58, 65

[56] References Cited

U.S. PATENT DOCUMENTS

| | | | |
|---|---|---|---|
| 1,025,001 | 4/1912 | Mann, Jr. | 131/7 |
| 1,942,899 | 1/1934 | Parsons | 131/7 |
| 2,844,152 | 7/1958 | De Capitani | 131/7 |
| 3,273,568 | 9/1966 | Di Carlo, Jr. | 131/7 |
| 3,692,030 | 9/1972 | Whang | 131/7 |

*Primary Examiner*—Robert W. Michell
*Assistant Examiner*—V. Millin
*Attorney, Agent, or Firm*—Wenderoth, Lind & Ponack

[57] ABSTRACT

A cigarette, small cigar or the like includes an individual lighting device which is applied to the fore end of the tube or tubular cover of the cigarette. The lighting device includes an essentially annular outer component which is adjacent to the fore end of the device and which is made of a first compound that can be set aflame by rubbing and that allows for a quick spreading of the flame, and an essentially tubular inner component which has an axial dimension greater than that of the outer component and which is made of a second compound that can be easily set aflame and that can be charred and temporarily converted into embers.

4 Claims, 6 Drawing Figures

14
20
10
18
12

10
18
P
A
D
B
A
B
D
B
18
22
20
A'
C

A'
C
L''
L'
L
L'''
10
20
16
22
18
12
B
D

S
34
30
32
34
32''
32'
32'
30
36

22a
18a
30
N
N'
30
N''
18'
20a
18
36'
N
20a
18a
22a

CIGARETTES HAVING AN INDIVIDUAL LIGHTING MEANS, AND METHOD OF MAKING THEREOF

BACKGROUND OF THE INVENTION

This invention generally relates to cigarettes, and also to cigars and small cigars, embodying in their fore tip, i.e. at the end opposite to the end fitted with a filter tip, or at any rate opposite to the end which is kept between the lips, means for the lighting thereof, without the need for recourse to exterior flame sources, as e.g. matches, lighters and the like.

In more detail, this invention relates to improvements made in and to cigarettes having an individual lighting means of the type comprising an essentially annular lighting member fitted at the fore end of the cigarette tube, usually made of paper, and having a composition which is capable of being lighted at least in a point of its contour by rubbing against a rough surface in a manner similar to the tip of a normal match, the composition containing a small amount of phosphor to ensure a quick spreading of combustion to the whole contour of the lighting member, thereby forming a narrow incandescent ring which lasts for a short time but which has sufficient heat to start the lighting of tobacco at the end of the cigarette.

Such cigarettes are already known in the art. In particular, a cigarette fitted with a lighting means of the above described type is disclosed and shown in U.S. Pat. No. 3,262,456, which includes a comprehensive list of patents which practically represent the development of technology in the field of the invention. Reference is therefore made to such patents for a more complete knowledge of precedents, premises and final aims of this invention.

However, such cigarettes, though enjoying a widespread diffusion, are not universally accepted, for several different reasons. One reason is cost, since recourse must be made to material and compounds by which the manufacturing costs are materially increased. Another reason is that the lighting operation, to be performed by rubbing a pre-established, narrow point of the contour of the cigarette end against a rough surface, is somewhat difficult and requires attention and experience on the part of the smoker. A further reason is the need of having special mechanical means and equipment for the precise and accurately located application of the lighting means to the cigarette, or more precisely to a thin paper strip by which the cigarette tube is formed, particularly in view of the very high speed of production of cigarettes. Such extremely high production speeds, of an order of many thousands of cigarettes, even with filter tips, per minute, have practically made impossible a corresponding application of lighting means, due to the difficulties encountered in the exact synchronization and accurate positioning of the various elements.

Moreover, in spite of continuing improved technical solutions proposed, the required degree of efficiency is not yet practically attained by such lighting means. The prior art, inclusive of its most advanced development as disclosed in U.S. Pat. No. 3,262,456, has always been confronted with the difficulty of solving conflicting technical problems, namely, the need for ensuring an extremely quick spreading of combustion from the initial point or narrow zone of lighting across the whole contour of the cigarette end, as required for a complete and consistent lighting of tobacco, and the need for maintaining the thus formed incandescent ring for a time sufficiently long (e.g. of an order of one second) to obtain a good priming of combustion to the tobacco.

The above two requirements are obviously directly in conflict. As a matter of fact, when considering the very small amounts of combustible and oxidizing materials that can be tolerated in the lighting means, those compositions which ensure a lively spreading of flame cannot maintain the flame long enough to ensure combustion of the tobacco. Conversely, a compound which in very small amounts and cross-sections would be able to maintain a flame long enough for combustion would not provide the required quick spreading of combustion.

SUMMARY OF THE INVENTION

The improvement of the invention makes it possible to solve the above problems by the realization and the application of a lighting means by which both of the above conflicting requirements can be wholly fulfilled. Moreover, the improvement of the invention makes it possible to form the lighting means in shapes and configurations, as well as with very small amounts of materials and compounds, so as to make particularly inexpensive, and therefore acceptable, production on an industrial scale of cigarettes and of small cigars which are fitted with individual lighting means. Additionally, the improvement according to the invention allows for recourse to and use of existing technologies by which cigarettes, even at very high production speeds, can be provided with individual lighting means, by means of processes similar to those followed for the application of filter tips to cigarettes, and even simplified with respect thereto. Such existing technologies are presently available and can be readily and directly adapted to the application of lighting means.

A cigarette fitted with an individual lighting means, improved according to the invention, essentially comprises an outer supporting tube (continuous or possibly discontinuous) covering at least the major part of the contour of the fore end of the cigarette, and made of a combustible sheet material, in particular of paper. Fitted on the outer side of such tube, and having a given axial size in particular of an order of a few millimeters, is a second smaller outer tube at a position adjacent the fore or outer edge of the first supporting tube. The second tube is made of a material that can be set aflame by rubbing, i.e. a material similar to compounds of which the tips of conventional safety matches are made. The second outer tube has a much smaller axial size, e.g. of an order of 1-2 millimeters. The material of the second tube is capable of a quick spreading of flame, caused by the rubbing of any point thereof, across the whole contour thereof. Inside of the outer tube, i.e. between it and the end portion of the cigarette tobaccos, is interposed a tubular layer having an axial size greater than that of the outer tube, e.g. nearly similar to that of the supporting tube, and made of a compound by which the combustion is more slowly spread, and that is able to form a ring of longer lasting embers.

BRIEF DESCRIPTION OF THE DRAWINGS

The above and further, more specific features and advantages of the invention will be disclosed in more detail hereinafter, along with a comparison thereof with the prior art, reference being made to the accompanying drawings, wherein.

DETAILED DESCRIPTION OF THE INVENTION

Figures 1, 2, 3, 4, 4A, 5:
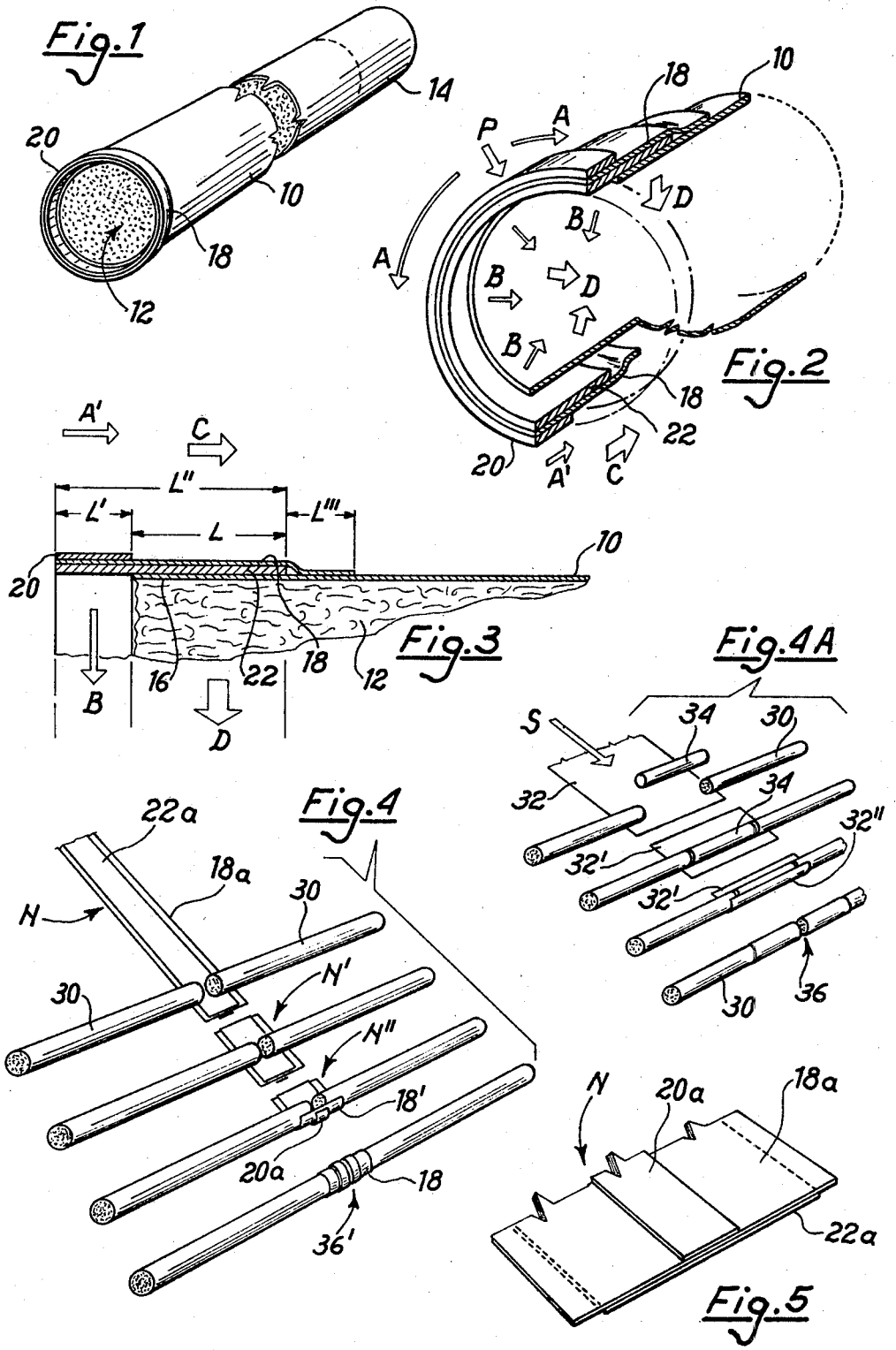
FIG. 1 is an enlarged perspective view of a typical cigarette improved according to the invention, a section of the length of the cigarette being shown broken away due to a lack of space.
FIG. 2 is a fragmentary, diagrammatic perspective view of the lighting means of the invention.
FIG. 3 is an enlarged fragmentary section taken on a radial plane through the end of a cigarette whereon the lighting means is fitted.
FIG. 4 is a perspective, diagrammatic view of the essential sequence of procedure which is employed for fitting the improved lighting means according to the invention to cigarettes while being manufactured and finished.
FIG. 4A, located sideways to FIG. 4 and graphically associated therewith, similarly represents the corresponding steps of procedure currently followed in the industrial manufacture of filter cigarettes, to show the possibility of utilization of already known means for the high-speed production of improved cigarettes according to the invention.
FIG. 5 is a fragmentary perspective view of a starting, composite band of material utilized for the formation and application of the lighting means.

FIGS. 1 and 2 are intentionally reproduced in a form essentially similar to that of corresponding FIGS. 1 and 2 of U.S. Pat. No. 3,262,456, to facilitate a comparison therewith, and to point out the peculiarities and advantages of the improved cigarette of the invention over the prior art.

Referring firstly to FIGS. 1 to 3 inclusive, the improved cigarette according to the invention conventionally comprises an outer tube 10, made of the usual relatively slow burning cigarette paper, having a thickness ranging from 0.03 up to 0.55 mm (other tobacco-based foil materials may be utilized in place thereof, when small cigars or the like are manufactured), and wherein the tobacco roll 12 is enclosed. Such components wholly pertain to already known technique, and therefore they will not be further described. Similarly, the possible presence of a conventional filter which may be coaxially applied to rear end 14 of the combustible portion of the cigarette, as well as the constitution of such a filter, are not inventive features of the invention.

The fore end 16 of tube 10, wherein the outer end of tobacco roll 12 is contained, is covered and wrapped over a given length L (see FIG. 3), e.g. of an order of 3–5 mm, by the lighting means of the invention, which consists of an uninterrupted or interrupted first supporting tube 18 of thin cigarette paper, or preferably of cigarette filter paper, having a thickness ranging from 0.03 up to 0.4 mm, and to the inner side of which is applied a thin coating of an also combustible compound, the purpose of which will be specified below. In a particularly preferred embodiment of the invention, tube 18 slightly protrudes by a length L', e.g. by 0.8–1.8 mm, from the fore end of tube 10.

A small annular coating or tiny ring 20 of a priming compound, similar to that utilized for the tips of safety matches, and containing potassium chlorate and bichromate, sulphur and a required amount of a binder, e.g. starch, extends all around the fore end of supporting tube 18 and covers tube 18 for a small axial distance, preferably of the same order of magnitude as projection L'. The compound of outer tube 20 that can be set aflame by rubbing against a phosphor containing surface is present in very small amounts on each cigarette, due to the very restricted axial size or width of layer 20, and of its very small thickness, not greater than 0.05–0.06 mm.

A coating of an easily combustible but slowly burning compound 22 is applied to the inner side of supporting tube 18. Such compound, which is particularly suitable for forming embers, consists of potassium chlorate and nitrate, a suitable binder (e.g. gum arabic), and a proportional amount of fibrils of a ligneous material, preferably consisting of strongly toasted tobacco or ribs of tobacco leaves, whereby its conversion into embers is made easy, and occurs with a negligible development of fumes and gas. Such second layer is preferably relatively thick, e.g. 0.07–0.11 mm thick, and has a length $L''=L+L'$, to thereby ensure a good covering of tobacco roll 12.

The action of the lighting means is obvious from FIGS. 2 and 3. The very lively and quickly spreading combustion of the compound of outer ring 20 is started by rubbing any point P of the contour of ring 20. Then the resultant flame is very quickly spread in the axial direction A' across the whole width L' of ring 20, and in both opposite peripheral directions A, thus forming a small ring of fire, which surrounds the cigarette end. Such lively combustion extends in a practically instantaneous manner, across the whole thickness of supporting tube 18, thereby igniting the underlying fore portion of combustible layer 22. Thus, in the fore portion L' of the lighting means, a quick radially inward transmission of flame occurs, as diagrammatically shown by the arrows B. Thereafter, the combustion is axially spread in the direction C, i.e. around the whole contour of the lighting means, as well as along the whole width or axial length L'' of lower layer 22, thus converting layer 22 into embers, and obviously lighting, by action in the direction D, the underlying fore portion 16 of tube 10 and of tobacco 12.

Since the composition of lower layer 22 includes components which are particularly suitable for charring and for a transitory formation of embers, following the formation of the tiny ring of fire due to combustion of tube 20, there then occurs the formation of a ring of embers which lasts for a given time, and which surrounds and properly lights the whole contour of the fore end of the cigarette and for a given portion of the length of the tobacco roll.

Such combustion is preferably stopped by the fact that a short rear length of supporting tube 18, having a length L''', e.g. of an order of magnitude of 0.5–1.5 mm, does not cover the lively combustible lower layer 22, but rather is in direct contact with the underlying annular portion of cigarette tube 10 and is connected thereto by an adhesive. Once the lighting is performed, without any inhalation on the part of the smoker, the uniform and slow combustion of the cigarette can proceed normally, both spontaneously, and with the aid of smoker inhalation.

The lighting means as previously disclosed, or an equivalent thereof, can be easily fitted to single cigarettes at operating speeds usually followed in the filter cigarette manufacturing industry. With reference now to FIG. 4A, there is shown the already well known technology of the association of filters to cigarettes (or better stated to semifinished products consisting of two axially abutting cigarette bodies). The semifinished cigarettes 30 are coaxially spaced and advanced together at high speeds in the direction S, along with a band 32 of cigarette paper. Simultaneously, a bit 34 of filter material is interposed between the spaced ends of abutting cigarettes. Band 32 is cut into short lengths 32', which are then wrapped around the filter material 34 and around short adjacent portions of cigarettes 30, as indicated by 32" in FIG. 4A. Finally, the thus connected two cigarettes are cut as at 36, thereby obtaining the two finished filter cigarettes.

With reference to FIG. 4, as previously disclosed the lighting means can be formed and fitted in a wholly similar manner, starting from a composite band N consisting of paper band 18*a*, by which the supporting tube 18 is formed. One side of band 18*a* is covered by a narrow coating 20*a*, which is designed to form the tiny priming ring 20. The opposite side of band 18*a* is covered by a wider coating 22*a*, designed to form the charring layer 22 to be converted into embers. The pairs of abutting cigarettes, preferably slightly spaced to allow for the abovedescribed projection of the lighting means, are advanced, concurrently with the band N, which is cut into lengths N' that are then wrapped, as indicated at N", by having recourse to advantageously simplified equipment and procedures similar to those usually utilized for the feeding, cutting and wrapping of cigarette paper band 32, by which the filter tips are structurally associated with the cigarettes, as described above.

The cutting operation, as at 36', made on the middle line of narrow strip 20*a* of priming compound, may possibly be made safer, in view of the danger of igniting the compound under strong mechanical stresses, and in particular such as by striking, by advantageously subdividing strip 20*a* into two narrower, parallel and slightly spaced strips, to thereby provide an intervening space in which the cutting blades are allowed to act on the paper only, without contacting the priming compound.

Preferred, but not exclusive, ranges of compositions for the formation of narrow annular priming strip 20 and of wider outer charring strip 22 designed to form embers, are shown below by example only.

The outer annular strip 20 for the formation of the ring of fire may be formed of: potassium chlorate 40–50 wt.%; potassium bichromate 3–10 wt.%; sulphur 0.5–4 wt.%; binder and related solvent and diluent 54.5–24 wt.%; inert filler (calcium carbonate and/or magnesium carbonate, and/or kieselguhr) 2–12 wt.%.

The inner annular strip 22 for the formation of an ember ring may be formed of: potassium chlorate 30–40 wt.%; potassium nitrate 8–12 wt.%; powdered toasted tobacco 8–12 wt.%; binder and related solvent and diluent 54–36 wt.%.

What I claim is:

1. A process for manufacturing tobacco articles, such as cigarettes, small cigars and the like, having on outer ends thereof self-lighting means for lighting the tobacco articles without the use of external heat sources, said process comprising:

providing conventional tobacco articles and advancing said tobacco articles in a feed direction, with said tobacco articles arranged in pairs extending transverse to said feed direction, and with adjacent ends of said tobacco articles of each said pair being coaxially spaced;

forming an elongated continuous composite band including a continuous supporting band of combustible material having on a first side thereof a continuous outer band of a first material that can be ignited by rubbing and that allows for a quick spreading of flame, said supporting band having on a second side thereof a continuous inner band of a second material that can easily be ignited and that can be charred and converted into embers capable of igniting said tobacco articles;

longitudinally advancing said composite band in said feed direction to a position adjacent said adjacent ends of said pairs of advancing tobacco articles;

dividing said advancing composite band into pieces having lengths, taken in said feed direction, substantially equal to the circumferential dimensions of said tobacco articles;

wrapping each said piece circumferentially around said adjacent ends of a respective said pair of tobacco articles, such that said first material is positioned radially outwardly and said second material is positioned radially inwardly and in contact with the outer circumferences of said ends of said respective pair of tobacco articles; and dividing the thus wrapped pieces substantially between the said adjacent ends of said respective pairs of tobacco articles.

2. A process as claimed in claim 1, wherein said inner band has a greater width than said outer band.

3. A process as claimed in claim 1, wherein each said piece is wrapped around the respective said pair of tobacco articles such that a portion of said inner band projects outwardly beyond and between said adjacent ends of said pair of tobacco articles.

4. A process as claimed in claim 3, wherein said outer band is positioned to project outwardly beyond and between said adjacent ends of said pair of tobacco articles.

* * * * *